United States Patent [19]

Markle

[11] Patent Number: 5,025,706

[45] Date of Patent: Jun. 25, 1991

[54] CONTROLLED DEPTH PRIMER SEATING TOOL

[76] Inventor: Kenneth E. Markle, 2525 Primrose Lane, York, Pa. 17404

[21] Appl. No.: 462,454

[22] Filed: Jan. 9, 1990

[51] Int. Cl.[5] ..... F42B 33/04

[52] U.S. Cl. ..... 86/37; 86/36

[58] Field of Search ..... 86/36, 37

[56] References Cited

U.S. PATENT DOCUMENTS

| | | | |
|---|---|---|---|
| 3,259,007 | 7/1966 | Havourd et al. | 367/37 |
| 3,313,201 | 4/1967 | Lawrence | 86/37 |
| 3,636,812 | 1/1972 | Nuler | 367/37 |
| 4,142,441 | 3/1979 | Schaenzer | 86/37 |
| 4,222,305 | 9/1980 | Lee | 86/37 |
| 4,590,841 | 5/1986 | Davis | 367/37 |

*Primary Examiner*—Deborah L. Kyle

*Assistant Examiner*—J. Woodrow Eldred

*Attorney, Agent, or Firm*—Samuel M. Learned, Jr.

[57] ABSTRACT

A controlled depth primer seating tool and method for use thereof in firearm cartridge loading and reloading operations, which enables the accurate measured depth of seating of a primer within the primer pocket of a center fire cartridge case by accommodating both cartridge case plus primer variations so that the measured depth of primer seating provides for a slight pre-load compression of the anvil head of the primer against the explosive compound contained therein whereby firing pin impact energy is thus optimally expended in effecting consistency of primer ignition with a corresponding enhancement of consistent ballistic characteristics from cartridge-to-cartridge and consequent accuracy from round-to-round.

17 Claims, 5 Drawing Sheets

Fig. 9
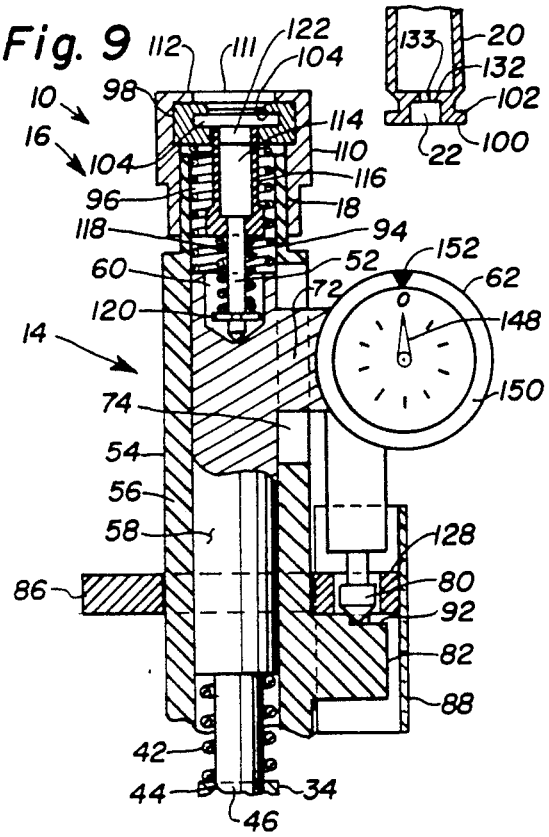
Fig. 10
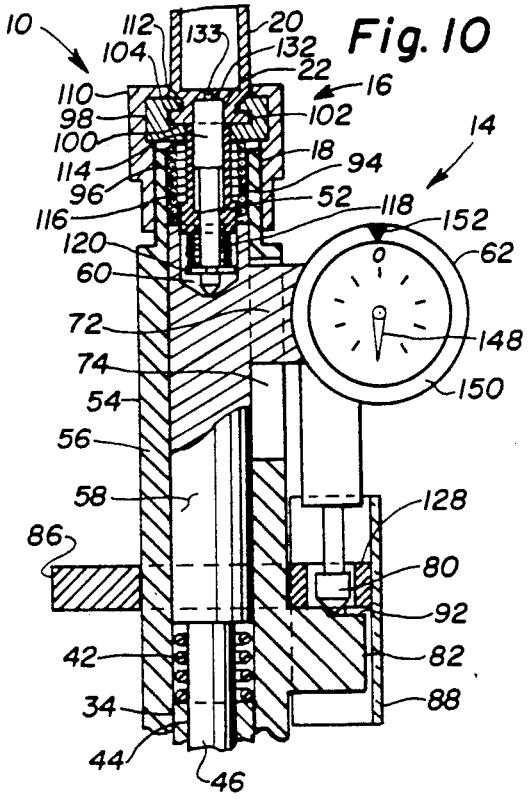
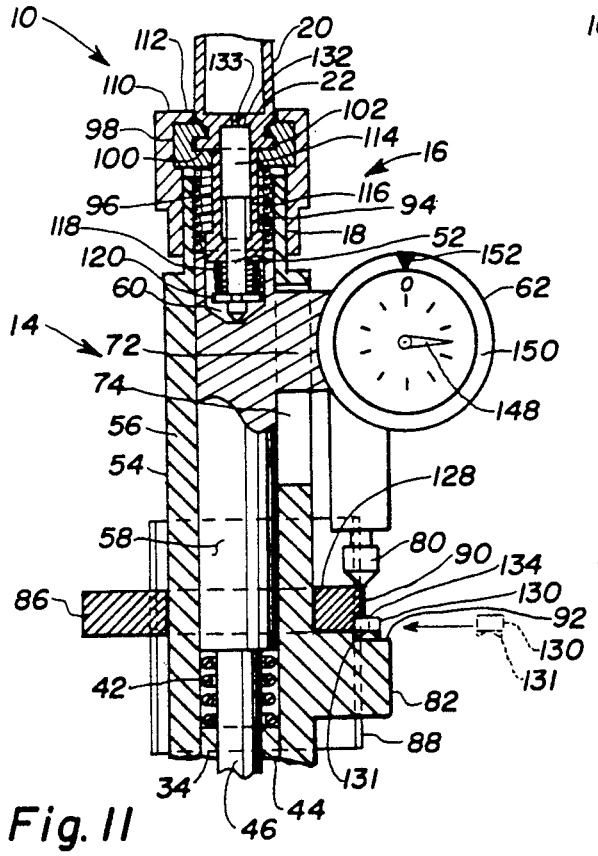
Fig. 11
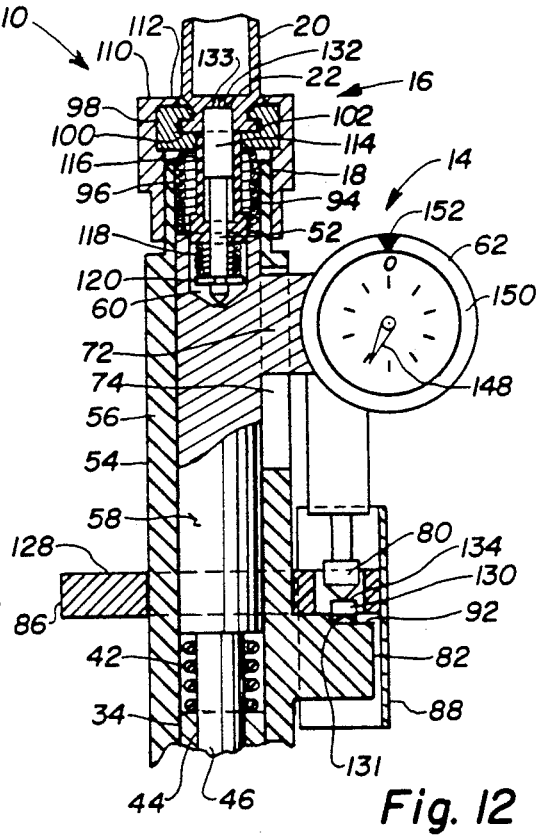
Fig. 12

CONTROLLED DEPTH PRIMER SEATING TOOL

BACKGROUND OF THE INVENTION

The present invention, subject of Disclosure Document No. 226238 Titled "CAPPER GAUGE FOR PRIMING SHELLS" which was Filed on May 8, 1989, relates to a portable hand-held manually activated controlled depth primer seating tool of a type employed by those engaged in reloading the cases of previously fired cartridges, and in particular for the insertion and precision seating of primers into center fire cartridge cases during the operations of reloading the same after firing. More specifically, for purposes of insuring consistency of cartridge ignition and thereby enhancing consistency of accuracy from round-to-round, the tool of instant invention is employed to seat primers to a known depth by precision measuring of primer and primer pocket variables of tolerance as well as the actual depth of primer insertion into the primer pocket in accomplishing seating, rather than by the heretofore so-called "feel" technique of primer seating as is that method generally employed in the use of most other primer seating tools. Also, it is to be understood that the tool subject hereof may be both satisfactorily and advantageously utilized for installing replacement primers to a measured depth of seating in center fire cartridge cases whether for rifle or pistol and whether of the rimmed or rimless type.

Among the marksmanship arts is that known as "precision" or "bench-rest" shooting, characterized by highly skilled and practiced individual employing finely tuned firearms and so-called "match" ammunition. The object of such marksmanship is basically the placement of all bullets through the same hole on the target at whatever range is being fired. In the accomplishment of such a marksmanship feat, the mechanical variables in firearm functioning and ballistic variables in ammunition performance must be reduced to minimum, and in the subject of this disclosure it is specifically the primer seating considerations attributable to reducing ballistic variables in ammunition performance to a minimum with which we are dealing.

Primer seating in cartridge reloading operations is typically accomplished with either a bench-mounted tool such as that taught by Lawrence in U.S. Pat. No. 3,313,201 dated Apr. 11, 1967, or a portable hand-held tool such as those respectively taught by either Schaenzer in U.S. Pat. No. 4,142,441 dated Mar. 6, 1979, and Lee in U.S. Pat. No. 4,222,305 dated Sep. 16, 1980, wherein all such tools regardless of either primer or primer pocket measurement and configuration variables compressively seat the primer to either a fixed depth as in the case of the Lawrence bench tool, or a depth of primer seating which "feels" right to the operator's sense of touch when tools such as those taught by Schaenzer and Lee are employed.

It is known that the level of sensitivity as well as reliability of primers is substantially effected by inconsistent and improper seating thereof, and certainly that the consistency of ignition of primers is directly related to the consistency of seating which in turn correlates to consistency of ignition of the cartridge main propellant charge and thereby the ballistic characteristic or a projected bullet and resultant consistency of accuracy delivered by a marksman and his firearm from round-to-round.

For purposes of discussion herein at present only, presume that all other variable firearm, shooter, environmental, and ammunition factors except primer seating are fixed and that we are dealing with primer seating variables only. In controlling primer seating variables there are two primary factors of importance under control of the reloader in gaining reliable consistency of primer ignition, and these are the proper orientation and positioning of the anvil head within the primer cup in relationship to the explosive compound held and retained therewithin so that when the firing pin strikes the primer all firing pin impact energy is expended in effecting detonation of an optimally sensitized explosive compound, which is accomplished when the head of the anvil is slightly pre-load compressed into the explosive compound so that optimum ignition sensitivity results from the compressive stresses set up therein, and the anvil head is neither removed from nor crushed into the explosive compound.

Reliable and consistent achievement of the proper orientation and positioning of the anvil head with respect to the explosive compound within a primer cap during the seating thereof within a center fire cartridge case primer pocket can only be repeatably accomplished by physically measuring and compensating for the primer variables, which is even true when the primer pocket has been previously reamed to both a uniform diameter and depth. The applicant herein by his invention provides a convenient new and novel tool as well as method for overcoming the problem of reloader non-uniformity in accomplishing the primer seating operation from cartridge-to-cartridge, and thereby eliminating the detrimental cartridge ignition and lack of accuracy consequences otherwise attributable thereto and consequent therefrom.

SUMMARY OF THE INVENTION

It is the principal object of the present invention to provide a controlled depth primer seating tool whereby a primer may be seated within a center fire cartridge case primer pocket with accuracy and certainty to an exact and desired measured depth regardless of the cartridge case and primer tolerance variations.

It is another object of the present invention to provide a controlled depth primer seating tool which seats the primer squarely within a primer pocket whereby the projecting legs of the primer anvil all contact the primer pocket base and the head of the anvil is thereby in turn consistently squared with the primer explosive compound deposited and held within the primer cup.

It is also an object of the present invention to provide a controlled depth primer seating tool having the capability for precisely measuring the depth of primer seating and pre-load compression of the anvil head against the explosive compound to thereby insure optimum detonation thereof.

Still another object of the present invention is to provide a controlled depth primer seating tool through the use of which one may achieve uniform primer seating within the primer pocket of a center fire cartridge case during reloading operations, whereby consistency of ignition is insured, and thereby accuracy from round-to-round is enhanced.

A further object of the present invention is to provide a controlled depth primer seating tool which locks the cartridge case against the case head face rather than the rim during primer seating operations to thereby eliminate depth of primer seating variables due to wear and thickness variables in case rims and shell holder flanges.

Yet another object of the present invention is to provide a controlled depth primer seating tool which embodies a safety shield to protect the tool operator in the event of an accidental primer detonation during the primer measurement operational use thereof.

It is also an object of the present invention to provide a controlled depth primer seating tool which is portable, hand-held, and manually activated so that it may be conveniently and suitably employed in the field for shooting site reloading operations.

An additional object of the present invention is to provide a controlled depth primer seating tool and method for seating primers by the use thereof which is much more accurate than the currently used "feel" method tools.

The foregoing and other objects hereof, will be readily evident upon a study of the following specification and accompanying drawings comprising a part thereof.

BRIEF DESCRIPTION OF THE DRAWINGS

FIGS. 9–18 show in a progressive series of cut-away side elevation views the sequence of operational steps in using, and the mechanical functioning of, the tool of instant invention when employed in accomplished precision measured seating of a primer within the primer pocket of a typical center fire cartridge case.

DETAILED DESCRIPTION OF THE INVENTION

Figures 1, 2:
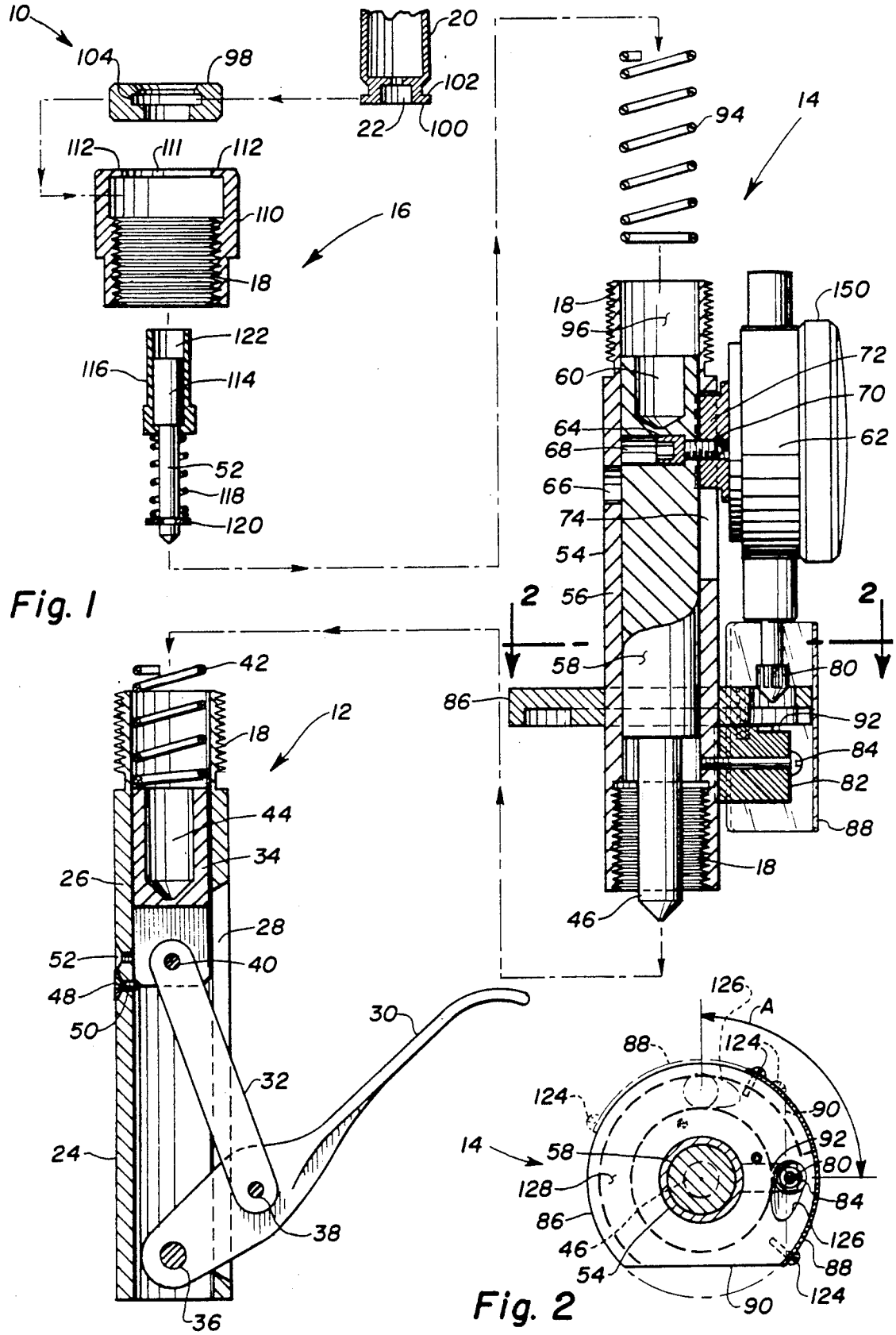
FIG. 1 is an exploded side elevation cut-away assembly view of the component parts comprising the controlled depth primer seating tool of instant invention.
FIG. 2 is a top sectional view of the safety shield rotation section of the dial measurement component assembly, as shown in FIG. 1 and seen along the line 2—2 thereof.

Referring to FIG. 1, the controlled depth primer seating tool 10 of present invention, and the component parts thereof comprising the same are shown in an exploded side elevation cut-away assembly view, which component parts consist of the seater assembly 12, the dial measurement component assembly 14, and the combined primer seater and shell holder assembly 16, all of which are mechanically joined one to the other in an axially aligned vertically progressive configuration, as the phantom assembly line indicates, by means of the complementary threaded assembly sections 18. Functionally, the seater assembly 12 houses and supports the lever and linkage means whereby the tool 10 is hand-held and manually activated, the dial measurement component assembly 14 supports the means whereby pertinent dimensional variables of both a particular primer to be seated and the center fire cartridge case 20 primer pocket 22 within which seating is to take place as well as the depth of primer seating within that primer pocket are all measured, and the combined primer seater and shell holder assembly 16 functions to hold and support both the primer to be seated and the case 20 in proper vertically axial aligned relationship for seater assembly 12 manual activation and dial measurement component assembly 14 measured seating of the primer within the primer pocket 22.

Referring again to FIG. 1 to consider generally at this time the structural aspects of each of the above-mentioned assemblies, and considering first among them the seater assembly 12.

The seater assembly 12 is housed and supported within a seater body 24 generally of tubular configuration having a seater body side-wall 26 within which is provided a slotted opening 28 to accommodate manually pivotal operation of the seater handle 30 which translates through toggle link 32 as reciprocation of the spring-loaded seater piston 34. The seater handle 30 is pivotally assembled within the seater body 24 by means of handle pintle 36, and at a spaced distance therefrom along said handle 30 it is also pivotally connected to one end of the toggle link 32 by means of link pintle 38. The other end of the toggle link 32 is pivotally connected to the seater piston 34 by piston pintle 40, all of which pivotally assembled linkage operates against the compressive force of the seater spring 42 when the seater assembly 12 is operationally connected by means of the complementary threaded section 18 to the dial measurement component assembly 14 for measured depth primer seating use. It will be noted that the seater piston 34 is provided with a center-bore opening 44 adapted to slidably receive and movably engage the dial measurement component assembly operating rod 46 for which use the handle opening limit screw 48 is set in the lower position opening 50. If the seater body, however, is optionally employed in a "feel" primer seater mode, by connection of the combined primer seater and shell holder assembly 16 directly thereto by means of the complementary threaded assembly section 18, without the interposed connection of the dial measurement component assembly 14 therebetween, then the handle opening limit screw 48 is secured in the upper position opening 52 and the seater spring 42 is replaced with a longer spring to compensate for the mechanical differences between the dial measurement component assembly operating rod 46 and the primer seater operating rod 52.

Considering now the dial measurement component assembly 14 as shown in FIG. 1 and the general structural aspects thereof, and as previously described and shown by the phantom assembly line the same mechanically connects to the seater piston end of the seater assembly 12 by means of the complementary threaded assembly section 18 with the operating rod 46 thereof axially aligned vertically to be slidably received within the center-bore opening 44 of the seater piston 34.

The dial measurement component assembly 14 is housed and supported within the component assembly body 54, also generally of tubular configuration and complementary in diameter to that of the seater body 24, with a component assembly side wall 56. Slidably installed and reciprocally operational within the interior side-wall diameter of the component assembly body 54 is the dial measurement component assembly operating shaft 58 which has integral thereto and axially extending vertically downward from the lower end thereof the operating rod 46, and counter-bored in axial vertical alignment within the upper end thereof a primer seater operating rod recess 60 adapted to received and moveably engage the primer seater operating rod 52 during both primer pocket measurement and measured primer seating operations. Attached to and moveable with the operating shaft 58 during use employment of the tool 10 is the dial measurement gauge 62 which is fixedly assembled thereto by means of the dial gauge retaining screw 64 inserted through the assembly body screw opening 66 and retained within the operating shaft screw recess 68 in threadable engagement with the threaded opening 70 in the dial gauge mounting block 72 as shown. And, so that the dial measurement gauge 62 may move vertically up and down with the operating shaft 58 during tool 10 use employment, the component assembly body 54 is further provided with a vertical slot opening 74 to accommodate the dial gauge mounting block 72 and therefore the dial measurement gauge 62 up and down movement during vertical diaplacement of the operating shaft 58.

Affixed to the component assembly body 54, below the dial measurement gauge probe 80 and on alignment therewith is the primer pedestal 82 connected by means of the primer pedestal affixment screw 84, and supported upon the primer pedestal 82 and rotatable with respect thereto axially about the component assembly body 54 upon which it is slidably assembly is the gauge probe cam table 86 which supports and carries the safety shield 88. The function of the gauge probe cam table 86 is two-fold, the first being to rotatably elevate the gauge probe 80 and move the gauge probe cam table flat 90, which does not show in FIG. 1 but is seen in FIG. 2 and certain subsequent Figures, to expose the primer pedestal primer support surface 92 for facilitated primer placement and removal during primer measurement operations, and the second being to also contemporaneous with the foregoing rotate the safety shield 88 into and out of protective position during the aforementioned primer measurement operations to thereby provide protection in the event of an inadvertent or accidental primer detonation during the carrying out of such primer measurement operations.

Lastly, the shell holder compression spring 94 is retained and held within the spring recess 96 therefor in the upper end of the component assembly body 54, and functions to bear upon the shell holder 98 in locking the shell holder 98 against the shell holder retaining lips 112.

Regarding now the structure and function of the combined primer seater and shell holder assembly 16 as shown in FIG. 1, which is comprised of the shell holder retaining cap 110 having a complementary threaded assembly section 18 for mechanical connection thereof with the corresponding complementary threaded assembly section 18 of the dial measurement component assembly 14 as shown by the phantom assembly line. The shell holder retaining cap 110 is provided with an open top shell holder retaining slot 111 having shell holder retaining lips 112 in the upper portion thereof wherein said retaining slot 111 is dimensioned to interchangeably received and supportably retain a standard commercial shell holder 98 as appropriate for whatever cartridge caliber is being primed with tool 10. Inserted and retained within the coil opening of the shell holder compression spring 94 is the primer seater 114 which has assembled thereto a retractable spring loaded primer retaining shroud 116 operable against a shroud compression spring 118 that is insertably received upon the primer seater operating rod 52 and secured thereon by the spring retention clip 120, the latter being that portion of the primer seater received within and supported by the primer seater operating rod recess 60. The primer seater structure as above-described provides a primer retention cup 122 which receives and positions a primer for seating during use application of tool 10 as will hereinafter be more fully described.

The controlled depth primer seating tool 10 as shown and illustrated in FIG. 1, and certain subsequent Figures hereinafter, may be cast or machined and fabricated from various metals and alloys thereof, or plastics, or combinations of metals and metal alloys and plastics by methods and techniques commonly employed in such operations. The dial measurement gauge 62 which measures in units of thounsandths-of-an-inch is a standard commercially available item, employed as herein described without modification of the mechanical measurement functions thereof.

Referring now to the top sectional view of the safety shield rotation section of the dial measurement component assembly 14 as illustrated in FIG. 2, wherein is shown more specifically a 90-degree rotation of the safety shield 88, as designated by the arcuate arrow "A", from a safety shield 88 protective position during primer retention upon the primer pedestal support surface 92 for primer measurement as shown in solid line rendition thereof, to a safety shield 88 rotatably removed position for primer placement upon and removal from the primer pedestal support surface 92 before and after the accomplishement of primer measurement operations as shown in phantom line rendition thereof. Additionally shown in FIG. 2 are the safety shield attachment screws 124 which affix through openings in the safety shield 88 plastic material threadably into openings provided within the periphery of the gauge probe cam table 86 to secure the safety shield 88 thereto. And also shown in FIG. 2 is the gauge probe cam 126 which provides an inclined surface so that upon rotation of the gauge probe cam table 86 the inclined surface functions to cam the dial measurement gauge probe 80 into an elevated out-of-the-way position upon the gauge probe cam table top 128 and thereby enable open and facilitated access to the primer pedestal primer support surface 92 for placement of a primer thereto and removal of a primer therefrom.

Considering now that series of illustrations shown on the second sheet of Drawings, being FIGS. 3 through 8, which show various aspects of primer seating and primer seating variables to be dealt with in accomplishing the mechanical placement of a primer 130 within a center fire cartridge case 20 primer pocket 22.

Figure 3:
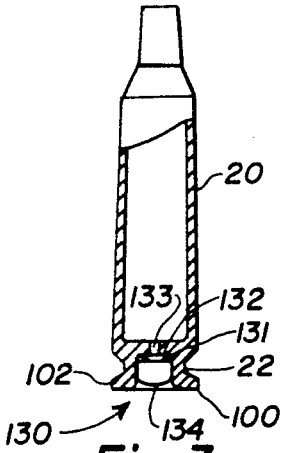
FIG. 3 is a cut-away side elevation view of a typical center fire cartridgecase showing a primer seated therein.
Figure 4:
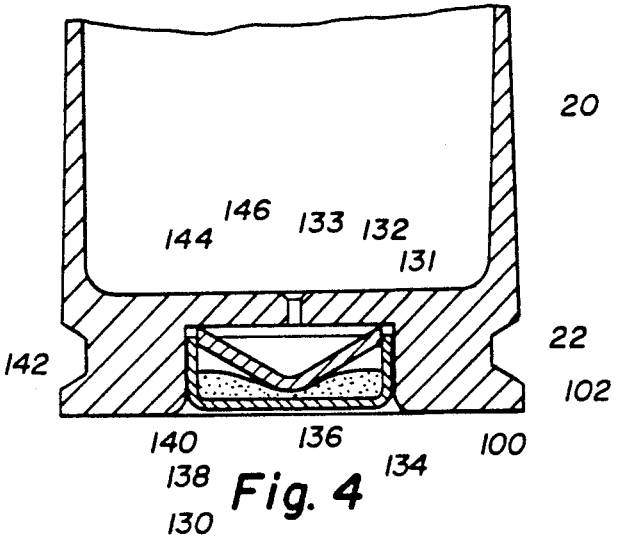
FIG. 4 is an enlarged cut-away side elevation view of a primer shown properly seated in the primer pocket of a typical center fire cartridge case.

The view shown in FIG. 3 is that of a typical center fire cartridge case 20, which has been cut-away to more clearly illustrate the structural aspects thereof as related to the seating of a primer 130 within the primer pocket 22 thereof. The geometry of proper primer seating is shown in FIG. 3, and in greater detail in enlarged FIG. 4, which includes squarely seating the primer 130 within the primer pocket 22 with all primer anvil feet 131 in firm contact with the primer pocket base 132, on alignment with the case flash-hole 133 through which the flame of a detonated primer passes to ignite the main propellant charge of the loaded cartridge, with the primer head 134 set sub-flush to the case head face 100 so that the primer is protected against accidental impact discharge during normal cartridge handling and firearm loading operations, and the head of the primer anvil 136 is slightly pre-load compressed into the primer cap explosive compound 138 with the explosive compound protective paper 140 sandwiched therebetween as is shown in FIG. 4. If primers are consistently seated with reliability in the foregoing manner, then there will be consistency of primer ignition which in turn will, all other factors being equal, insure consistency of cartridge ballistic performance thereby enhancing accuracy.

In the foregoing regard it is to be understood that normal case prepatory procedures typically performed prior to the actual reloading of high performance match ammunition would include a visual inspection pre-grading of all cases for both uniformity and servicability, then all cases would have been die-sized and neck-trimmed to uniform length, the primer pockets would have been reamed to uniform depth and diameter, the flash holes reamed to remove burrs and irregularities, and finally the cases would be cleaned and polished before reloading. Thus, all reasonable steps would have been taken to insure there being dimensioned uniformity in a batch of cases for reloading prior to reloading. The one remaining significant case variable per se for which normally no specific mechanical uniformity pre-loading operation would have been performed is that of the case rim 102 profile and thickness. And, although the case rims 102 can be machined to uniform profile and dimension of thickness and diameter, such is not usually a case prepatory procedure for reloading.

Figure 5:
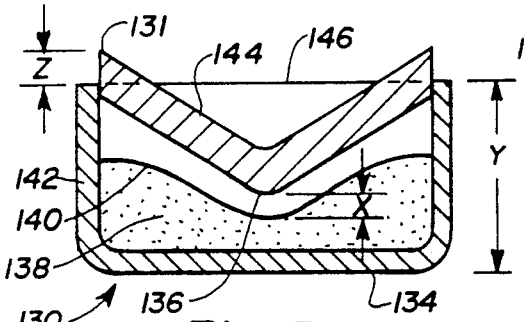
FIG. 5 is an enlarged cut-away side elevation view of a typical primer shown as it would normally appear prior to the seating thereof in a cartridge case primer pocket.
Figure 6:
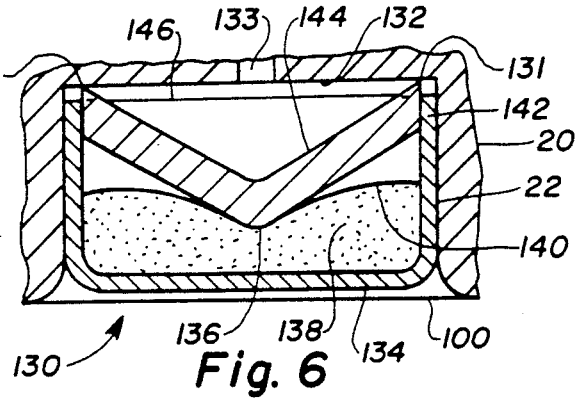
FIG. 6 is an enlarged cut-away side elevation view of the typical primer shown as it would appear properly seated in the primer pocket of a typical center fire cartridge case.

Referring now to FIG. 5, which is an enlarged illustration of the typical center fire cartridge primer 130 as the same would normally be received for reloading operations. Typically, the primer cap explosive compound 138 is mechanically measured and deposited in the primer cup 142 in a semi-solid or paste form, after-which the explosive compound protective paper 140 is inserted within the primer cup 142 over the explosive compound 138, and then the primer anvil 144 which has a head 136 and normally three feet 131 projecting downwardly therefrom is compressively inserted within the primer cup 142 as shown in FIG. 5 to complete the primer 130 assembly. Thereafter, primers are subjected to a low-temperature thermal operation to both dry and cure the primer cap explosive compound 138, and in so doing the explosive compound 138 shrinks and a gap "X" is formed therebetween and the head of the primer anvil 136. The gap "X" in a small rifle or pistol primer is typically on the order of 0.001-inch, and in a large rifle or pistol primer typically on the order of 0.002-inch. Additional variable dimensions with respect to the vertical profile of the primer 130 include the amount of extension "Z" of the primer anvil foot 131 above the primer cup lip 146, which typically varies by an amount of 0.002 to 0.010-inch, and the height "y" of the primer cup 142 which typically varies within the range of 0.004 to 0.010-inch. With no other variables than those of the primer 130 as aforesaid, the only reliable way to consistently seat the primer 130 within a primer pocket 22 of a center fire cartridge case 20 is by a method or technique of measurement rather than "feel".

The view shown in FIG. 6 again represents the profile of a properly seated primer 130, which is positioned squarely in the primer pocket 22 with the anvil feet 131 thereof in firm contact with the primer pocket base 132. The primer head 134 is set sub-flush to the case head face 100, and the head of the primer anvil 136 is slightly pre-load compressed into the primer cap explosive compound 138 with the explosive compound protective paper 140 sandwiched therebetween. Thus, when the firing pin strikes the center of the primer on axial alignment with the head of the primer anvil 136, there is instantaneous, certain and consistent detonation of the primer 130.

Figure 7:
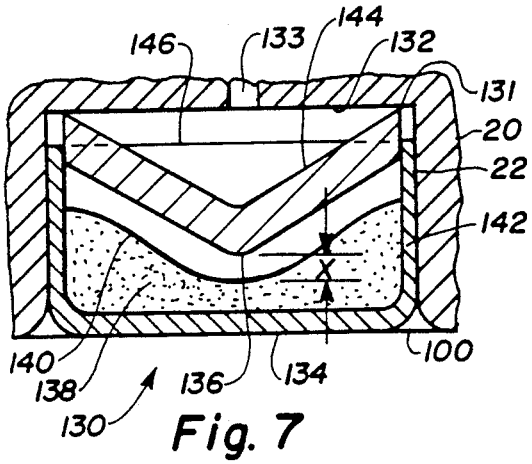
FIG. 7 is an enlarged cut-away side elevation view of the typical primer shown seated shallow in the primer pocket of a typical center fire cartridge case.

The view shown in FIG. 7 illustrates a primer that is set shallow in the primer pocket 22 so that when the firing pin strikes the center of the primer on axial alignment with the head of the primer anvil 136 a certain amount of firing pin energy must be consumed in driving the primer 130 deeper into the primer pocket 22 so that there is first contact of the head of the primer anvil 136 with the primer cap explosive compound 138, then an additional amount of firing pin energy is dissipated in obtaining pre-load detonation sensitizing of the explosive compound 138, and then if there is sufficient firing pin energy remaining there will be detonation, otherwise a hang-fire or a mis-fire. And, in any event, there will not have been consistency of primer detonation, and both uniformity of ballistic characteristics of the projected bullet and the accuracy thereof, as well as shooter accuracy, will have suffered as a consequence of erratic primer detonation for not having been properly seated.

Figure 8:
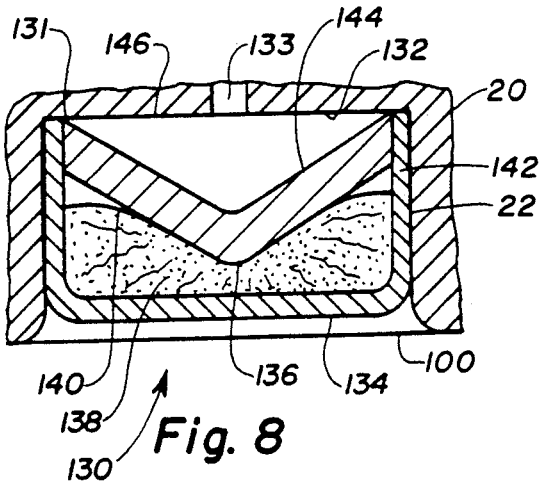
FIG. 8 is an enlarged cut-away side elevation view of the typical primer shown seated deep in the primer pocket of a typical center fire cartridge case.

In FIG. 8 the primer is shown as having been seated too deep so that the head of the primer anvil 136 is actually crushed into the primer cap explosive compound 138 which causes an erratic over-sensitizing and detonation burn thereof, again resulting in an inconsistency of primer performance and consequent loss of both ballistic and shooter accuracy as aforesaid. It can thus be clearly seen that if one has a random mix of inconsistently seated primers within a reloaded lot of match ammunition, then both ballistic and shooter accuracy will be correspondingly inconsistent.

Directing attention now to FIGS. 9 through 18 wherein is shown a progressive series of cut-away side elevation views depicting the sequential operational steps in using, and the mechanical functioning of, the controlled depth primer seating tool 10 of instant invention when the same is employed in accomplishing precision measured seating of a primer 130 within the primer pocket 22 of a typical center fire cartridge case 20, and considering first FIG. 9.

The view of tool 10 shown in FIG. 9 is one of it at the mechanically neutral rest position, such as was previously shown in FIG. 1, prior to commencement of the use thereof in accomplishing precision primer seating operations, and the case 20 to be primed is that as shown adjacent thereto. The only make-ready procedures for tool 10 use is first to insure that the proper primer seater 114 is installed, depending on whether one is seating large rifle or pistol or small rifle or pistol primers, and second to insure that the proper shell holder 98 for the particular caliber of cartridge case 20 to be reloaded is installed in the shell holder retaining cap 110. Otherwise, no other make-ready procedures for the use of tool 10 are necessary. Also as shown in FIG. 9, the dial measurement gauge needle 148 is in the rotatable dial face 150 neutral zero position 152, which although not a make-ready step per se, is arbitrarily so set for operational convenience.

The first actual procedural step to be performed in the measured depth case priming operation as accomplished by the use of tool 10 is that as shown in FIG. 10, wherein the case 20 to be primed is inserted into the shell holder 98 in a manner customarily known to those practiced in the art of center fire cartridge reloading. Once the case 20 to be primed is properly inserted and retained in the shell holder 98 as shown in FIG. 10, the seater handle 30 is then pressed and held in the closed position as fully shown in subsequent FIG. 17, thus compressing the seater spring 42 and the shell holder compression spring 94 and thereby extending the primer seater 114 into the primer pocket 22 until, acting as a depth probe, it locates the primer pocket base 132. Coincidental therewith, the retractable spring loaded primer retaining shroud 116 contacts the case head face 100 about the periphery of the primer pocket 22 and as it retracts under the upward directed force of the shroud compression spring 118 forces the case 20 upward so that the upward facing case rim 102 surface thereof is brought into peripheral contact with the downward facing surface of the shell holder flange 104, thus fixing any variable differential in the case rim 102 thickness profile at a base reference point for purposes of accomplishing both measurement of the primer pocket 22 depth and the depth of seating of a primer 130 therein.

Next, as illustrated in FIG. 11, with the seater handle 30 still held in the closed position, the gauge probe cam table 86 is rotated so as to thereby displace the safety shield 88 out of the way of the primer pedestal 82 and move the gauge probe cam table flat 90 into coincidence therewith whereby a primer 130 may be placed for measurement upon the primer pedestal primer support surface 92, and simultaneous therewith the dial measurement gauge probe 80 is contacted by the gauge probe cam 126 and elevated to an out-of-the-way position from the primer pedestal primer support surface 92 to the gauge probe cam table top 128. When the gauge probe cam table 86 has been rotatably moved through an arcuate displacement "A" as shown in FIG. 2, and the above mechanical functions accomplished, then a primer 130 may be positioned upon the primer pedestal primer support surface 92 as shown in FIG. 11.

Following positioning of the primer 130 for measurement as above described and with the seater handle 30 continuing to be held in the closed position, then, as shown in FIG. 12, the gauge probe cam table 86 is counter-rotated through arcuate displacement "A" to thereby return the safety shield 88 to a protective position and simultaneously therewith by reverse movement of the gauge probe cam 126 lower the dial measurement gauge probe 80 into compensating measurement contact with the primer head 134.

Figure 13:
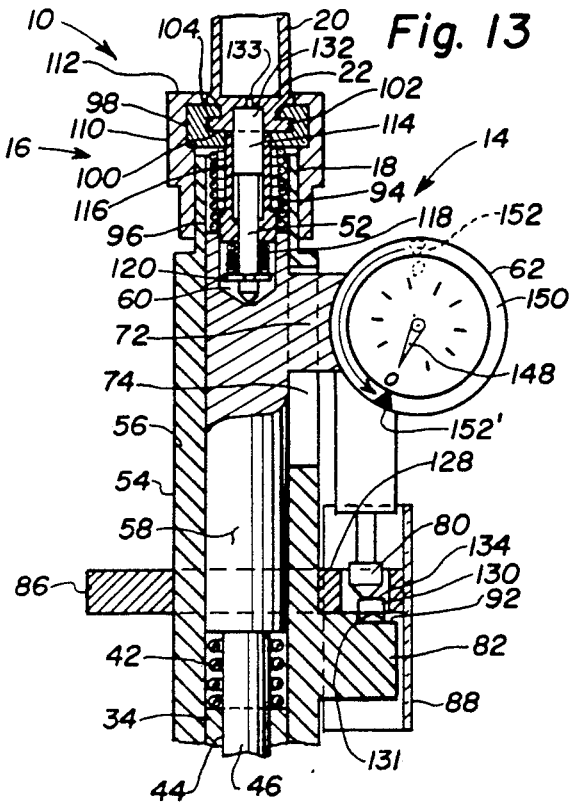

Considering now FIG. 13, wherein the tool 10 is shown as being maintained in the handle closed operational disposition as above-described for FIG. 12. At this point the effect of all pertinent primer seating variables, that is for the particular case 20 and primer 130 to be seated within the primer pocket 22 thereof, are measurably balanced to the nearest thousandths-of-an-inch for measured seating of the primer 130 by use of tool 10 to a depth within the primer pocket 22 where by use of the tool 10 the primer anvil feet 131 will be placed just into touching contact with the primer pocket base 132. However, in order to mechanically accomplish primer seating to a measured depth with tool 10 as described above, it is necessary to "zero" the dial measurement gauge 62 and thereby nullify all variables, which is accomplished as follows. The process of "zeroing" is simply carried out by rotatable movement of the rotatable dial face 150 from the initially and arbitrarily set neutral zero position 152 to the compensated neutral zero position 152', whereupon all variables are nullified.

Figure 14:
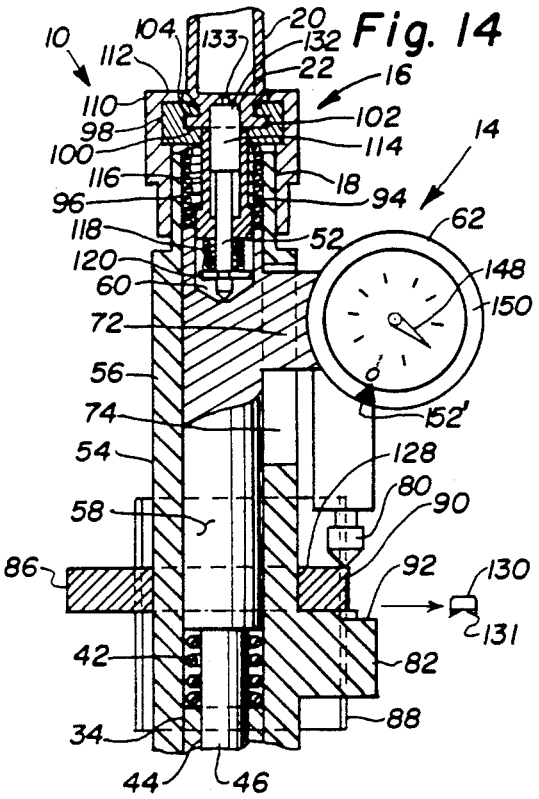
Figure 15:
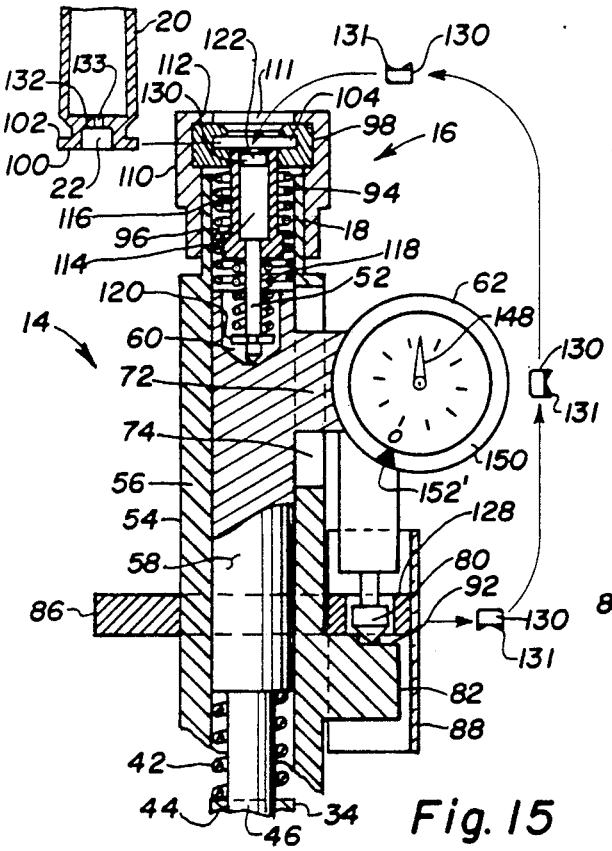

Following the zeroing operation, and with the seater handle 30 continuing to be held in a closed position, as shown in FIG. 14 the gauge probe cam table 86 is again rotated as previously described to provide access to the primer pedestal primer support surface 92 for removal of the now measured primer 130, following which the gauge probe cam table 86 is counter-rotated to the functionally protective position as shown in FIG. 15, and the seater handle is released.

With the tool 10 again disposed in a mechanically neutral configuration as shown in FIG. 15, the case 20 is removed from the shell holder 98, and the removed primer 130 is inverted from an anvil foot 131 down position to an anvil foot 131 up position, and then inserted into the primer retention cup 122. With the primer 130 thus loaded into the primer retention cup 122 the case 20 is then re-inserted into the shell holder 98, and the tool 10 is thereupon readied for an actual measured primer seating operation.

Figure 16:
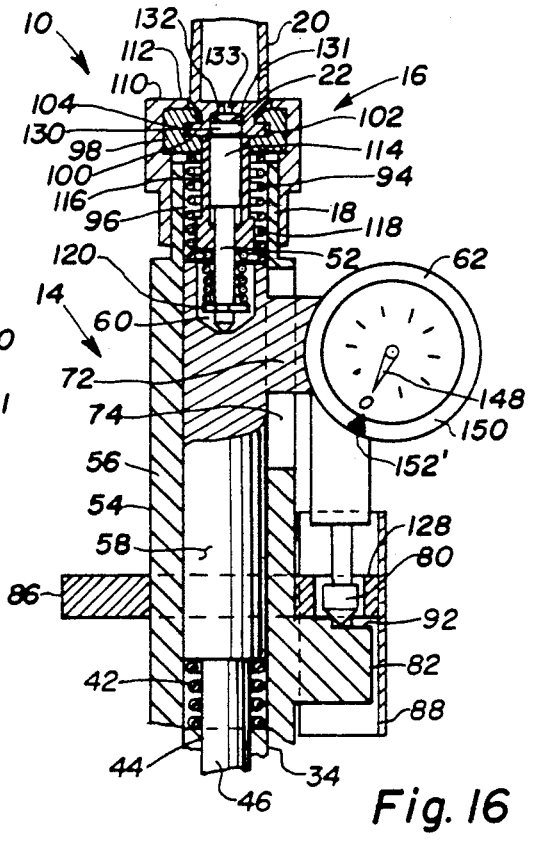

With the primer 130 loaded into tool 10 as above-described and shown in FIG. 15, and the case 20 as shown in FIG. 16, the seater handle 30 is again slowly closed until the dial measurement gauge needle 148 rotates back to the compensated neutral zero position 152', at which point the primer seater 114 will have pressed the primer 130 into the primer pocket 22 to a measured depth where the primer anvil feet 131 just touch the primer pocket base 132, also as shown in FIG. 16.

Figure 17:
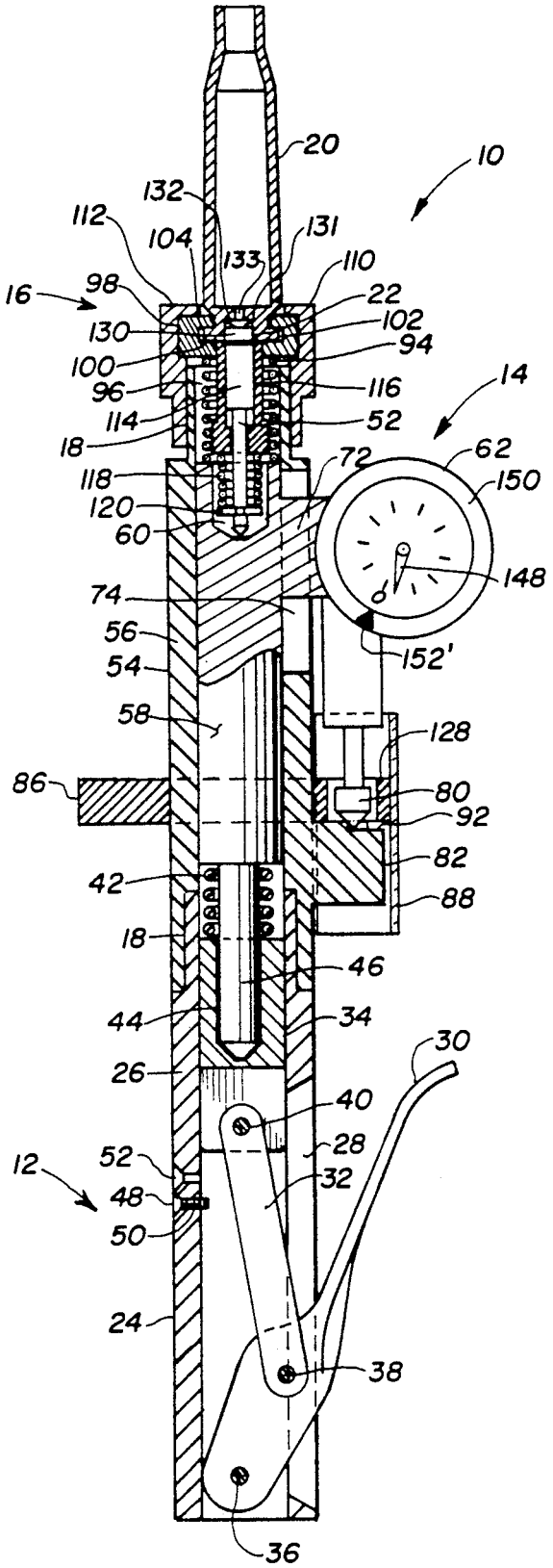

In order to compensate for the gap "X" between the primer anvil head 136 and the primer cap explosive compound 138 as previously illustrated and discussed on consideration of FIG. 5, it is now necessary in completing the measured depth primer seating operation to press the primer cup 142 down on the bottomed-out primer anvil feet 131 by an amount necessary to close the gap "X" and thereby press the primer anvil head 136 into firm pre-load contact with the explosive compound 138 for achieving consistency of primer detonation. Therefore, as illustrated in FIG. 17, one continues pressing the seater handle 30 until an additional depth of primer seating of 0.001-inch is indicated by the dial measurement gauge needle 148 as read on the dial measurement gauge 62 for completed seating of small pistol and rifle primers, or an additional depth of primer seating of 0.002-inch is read as above for completed seating of large pistol and rifle primers.

Figure 18:
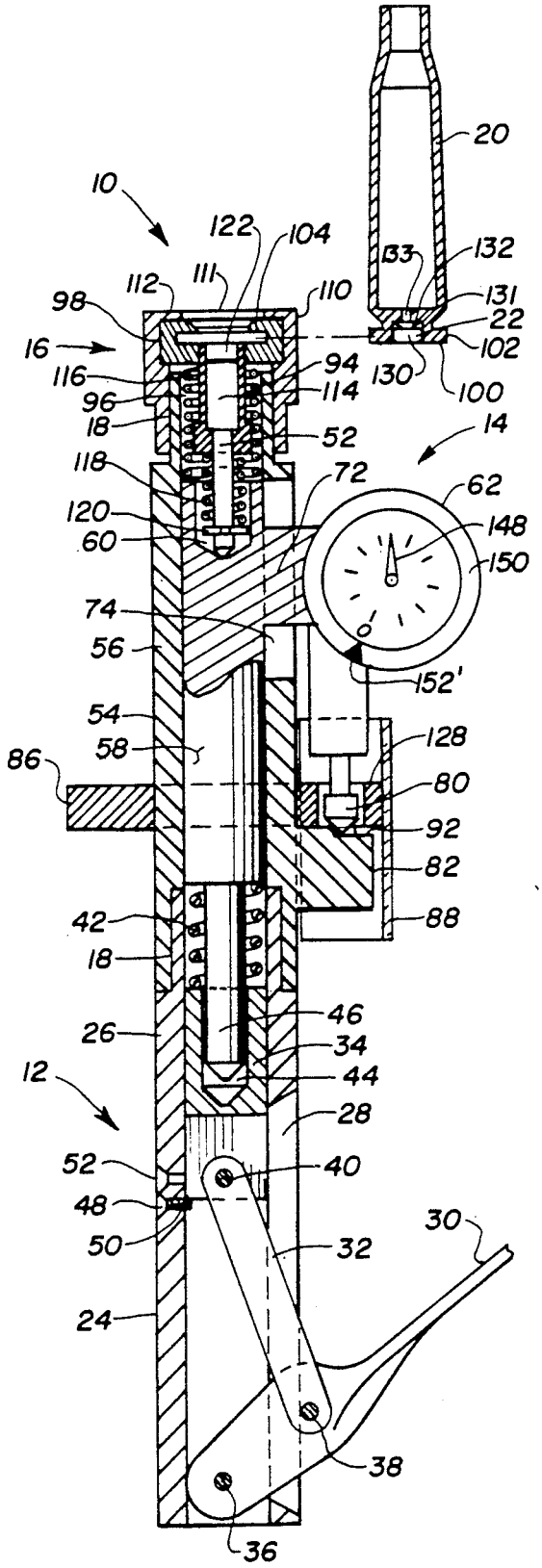

Finally, as shown in FIG. 18, all pressure on the seater handle 30 is released thereby withdrawing the primer seater 114 from operational contact and thereby allowing removal of the primed case 20 from the shell holder 98 for a repeated cycle of measured depth primer seating as accomplished with tool 10 in the manner as described above.

Although the controlled depth primer seating tool invention hereof, the structural characteristics and method of employment thereof, respectively have been shown and described in what is conceived to be the most practical and preferred embodiment, it is recognized that departures may be made respectively therefrom within the scope of the invention, which is not to be limited per se to those specific details as disclosed herein but is to be accorded the full scope of the claims so as to embrace any and all equivalent such devices, apparatus, and methods.

I claim:

1. A controlled depth primer seating tool, said tool comprising in combination a shell holder assembly adapted to receive and positionally retain a center fire cartridge case for priming, a primer seater having a primer retention cup and adapted by a mechanical linkage means of said tool to insertably probe a primer pocket of said positionally retained cartridge case and find and measure the depth thereof, a measurement assembly having a measuring means to differentially measure simultaneously between the primer pocket depth measurement and the height of a primer to be measurably seated within said primer pocket by means of said tool, a measurement assembly means to zero the simultaneous differential cartridge case primer pocket depth and primer height measurement difference thus taken, a seater assembly adapted to compressively seat said primer from receivable support within said primer retention cup of said primer seater to within said primer pocket to the measurement assembly zero differential setting, and by means of said tool compressively effect a pre-load overseating of said primer by a measured amount.

2. A controlled depth primer seating tool according to claim 1 wherein said shell holder assembly is adapted to interchangeably receive a plurality of different shell holders respectively for a corresponding plurality of different center fire cartridge case calibers.

3. a controlled depth primer seating tool according to claim 1 wherein said primer seater is adapted to receive and support a small rifle primer.

4. A controlled depth primer seating tool according to claim 1 wherein said primer seater is adapted to receive and support a large rifle primer.

5. A controlled depth primer seating tool according to claim 1 wherein said primer seater is adapted to receive and support a small pistol primer.

6. A controlled depth primer seating tool according to claim 1 wherein said primer seater is adapted to receive and support a large pistol primer.

7. A controlled depth primer seating tool according to claim 1 wherein said measuring means is a dial measurement gauge.

8. A controlled depth primer seating tool according to claim 3 wherein said primer to be measurably seated is a small rifle primer.

9. A controlled depth primer seating tool according to claim 4 wherein said primer to be measurably seated is a large rifle primer.

10. A controlled depth primer seating tool according to claim 5 wherein said primer to be measurably seated is a small pistol primer.

11. A controlled depth primer seating tool according to claim 6 wherein said primer to be measurably seated is a large pistol primer.

12. A controlled depth primer seating tool according to claim 7 wherein said measurement assembly means to zero is a rotatable dial face on said dial measurement gauge.

13. A controlled depth primer seating tool according to claim 8 wherein said primer pre-load overseating measured amount is 0.001-inch.

14. A controlled depth primer seating tool according to claim 9 wherein said primer pre-load overseating measured amount is 0.002-inch.

15. A controlled depth primer seating tool according to claim 10 wherein said primer pre-load overseating measured amount is 0.001-inch.

16. A controlled depth primer seating tool according to claim 11 wherein said primer pre-load overseating measured amount is 0.002-inch.

17. A method for accomplishing measured primer seating of a primer within a primer pocket of a center fire cartridge case, said method comprising the steps of inserting the base of a center fire cartridge case in the shell holder of a controlled depth primer seating tool, manually closing the seater handle of said tool to thereby insertably elevate the primer seater of said tool into the cartridge case primer pocket to locate the bottom and measure the depth thereof with a mechanically cooperative measurement gauge assembly of said tool, with the seater handle of said tool continuing to be manually held in the closed position placing the primer to be seated upon a primer pedestal support surface of said tool and then taking a simultaneous differential measurement reading with said mechanically cooperative measurement gauge assembly of said tool to thereby obtain a measurement difference reading between the cartridge case primer pocket depth and the height of the primer to be seated, with the seater handle of said tool continuing to be manually held in the closed position set the measurement gauge indicator of said tool to zero, release the seater handle and replace the primer from the primer pedestal support surface of said tool to the primer seater retention cup thereof and again manually close the seater handle until the measurement gauge indicator reads zero, and then effect a pre-load overseating of said primer by a measured amount.

* * * * *